US008834181B2

(12) United States Patent
Thompson

(10) Patent No.: US 8,834,181 B2
(45) Date of Patent: Sep. 16, 2014

(54) STRADDLE MOUNT ELECTRICAL CONNECTOR WITH FUSIBLE ELEMENTS

(71) Applicant: John P. Thompson, Carlisle, PA (US)

(72) Inventor: John P. Thompson, Carlisle, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 13/829,347

(22) Filed: Mar. 14, 2013

(65) Prior Publication Data

US 2013/0280927 A1 Oct. 24, 2013

Related U.S. Application Data

(60) Provisional application No. 61/635,030, filed on Apr. 18, 2012.

(51) Int. Cl.

| | |
|---|---|
| ***H01R 12/00*** | (2006.01) |
| ***H01R 24/00*** | (2011.01) |
| ***H01R 12/72*** | (2011.01) |
| ***H01R 43/02*** | (2006.01) |

(52) U.S. Cl.

CPC ..... *H01R 12/72* (2013.01); *H01R 24/00* (2013.01); *H01R 12/721* (2013.01); *H01R 12/725* (2013.01); *H01R 43/0256* (2013.01)

USPC ..... 439/62; 439/65; 439/630

(58) Field of Classification Search

USPC ..... 439/59–62, 65, 66, 83, 629, 630

See application file for complete search history.

(56) References Cited

U.S. PATENT DOCUMENTS

| | | | |
|---|---|---|---|
| 4,767,344 | A | 8/1988 | Noschese |
| 5,383,095 | A | 1/1995 | Korsunsky et al. |
| 6,247,635 | B1 | 6/2001 | Olson |
| 6,784,372 | B1 | 8/2004 | Yuen et al. |
| 7,179,091 | B2 | 2/2007 | Mongold |
| 7,204,699 | B2 | 4/2007 | Stoner et al. |
| 7,226,296 | B2 | 6/2007 | Ngo |
| 7,354,274 | B2 | 4/2008 | Minich |
| 7,442,050 | B1 | 10/2008 | Bhakta et al. |

*Primary Examiner* — Khiem Nguyen

(74) *Attorney, Agent, or Firm* — Baker & Hostetler LLP

(57) ABSTRACT

A straddle mount electrical connector with fusible elements is provided. The electrical connector can include a connector housing including a housing body that supports element support members that define a receptacle configured to receive a complementary electrical component therein. Each element support member can support a respective plurality of fusible elements, and each fusible element can be connected to a respective electrical contact supported by the connector housing. The pluralities of fusible elements can define a mounting interface of the electrical connector. The mounting interface can be configured to receive printed circuit boards of varying thicknesses.

26 Claims, 7 Drawing Sheets

STRADDLE MOUNT ELECTRICAL CONNECTOR WITH FUSIBLE ELEMENTS

CROSS-REFERENCE TO RELATED APPLICATIONS

This claims the benefit of U.S. Provisional Patent Application Ser. No. 61/635,030 filed Apr. 18, 2012, the disclosure of which is hereby incorporated by reference as if set forth in its entirety herein.

BACKGROUND

Electrical connectors can be provided as straddle mount electrical connectors configured to be mounted along an edge of a complementary electrical component, for instance a printed circuit board, such that at least a portion of the electrical connector straddles the edge of the printed circuit board. Straddle mount electrical connectors typically include electrical contacts with mating ends comprised of deflectable beams configured to receive a leading edge of the printed circuit board. Once mounted to the printed circuit board, the electrical contacts of known straddle mount electrical connectors are typically soldered to corresponding contact pads on the printed circuit board utilizing a solder reflow process.

Mounting known straddle mount electrical connectors to a printed circuit board can introduce errors into the manufacturing process of a printed circuit board assembly that includes the printed circuit board. For example, the deflectable beams of the mating ends of the electrical contacts of known straddle mount electrical connectors can scrape, or "snowplow" solder from the contact pads on the printed circuit board. Scraped solder material can reflow to adjacent electrical contacts, causing shorts or shunts in the finished printed circuit board assembly. Additionally, the deflectable beams of the mating ends of the electrical contacts of known straddle mount electrical connectors can impart forces that oppose mounting of the straddle mount electrical connector onto the printed circuit board, which forces can cause the printed circuit board to vibrate, thereby causing other components of the printed circuit board assembly placed on the printed circuit board to become displaced from their respective desired locations on the printed circuit board prior to the solder reflow process.

SUMMARY

In accordance with an embodiment, an electrical connector can include a connector housing including a housing body that defines a mounting interface configured to be mounted to a first electrical component and a mating interface configured to mate with a second electrical component. The connector housing can include opposed first and second element support members. The first and second element support members can be spaced from one another such that a receptacle is defined therebetween at the mounting interface. The receptacle can be configured to receive the first electrical component. The electrical connector can further include a first plurality of electrical contacts supported by the connector housing. The first plurality of electrical contacts can define respective first mating ends that are configured to electrically connect to the second electrical component, and a plurality of first mounting ends. The electrical connector can further include a first plurality of fusible elements supported by respective ones of the first mounting ends such that the first plurality of fusible elements are in electrical communication with respective ones of the first mating ends. Each of the first plurality of fusible elements can be supported by the first element support member and can be configured to be fused to a first side of the first electrical component.

The electrical connector can further include a second plurality of electrical contacts supported by the connector housing. The second plurality of electrical contacts can define respective second mating ends that are configured to electrically connect to the second electrical component, and a plurality of second mounting ends. The electrical connector can further include a second plurality of fusible elements supported by respective ones of the second mounting ends such that the second plurality of fusible elements are in electrical communication with respective ones of the second mating ends. Each of the second plurality of fusible elements can be supported by the second element support member and can be configured to be fused to a second side of the first electrical component that is opposite the first side of the first electrical component.

In accordance with another embodiment, an electrical connector can include a connector housing having a receptacle that defines a mounting interface configured to receive a first electrical component, and a mating interface configured to mate with a second electrical component. The connector housing can include an element support member. The electrical connector can further include a plurality of electrical contacts supported by the connector housing. The plurality of electrical contacts can define respective mating ends that are configured to electrically connect to the second electrical component, and respective mounting ends. The electrical connector can further include a plurality of fusible elements supported by respective ones of the mounting ends at the mounting interface of the connector housing. Each of the plurality of fusible elements can be in electrical communication with a respective one of the first mating ends. Each of the plurality of fusible elements can be supported by the element support member and can be configured to be fused to the first electrical component that is received in the recess of the connector housing.

BRIEF DESCRIPTION OF THE DRAWINGS

The foregoing summary, as well as the following detailed description of an example embodiment of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1A:
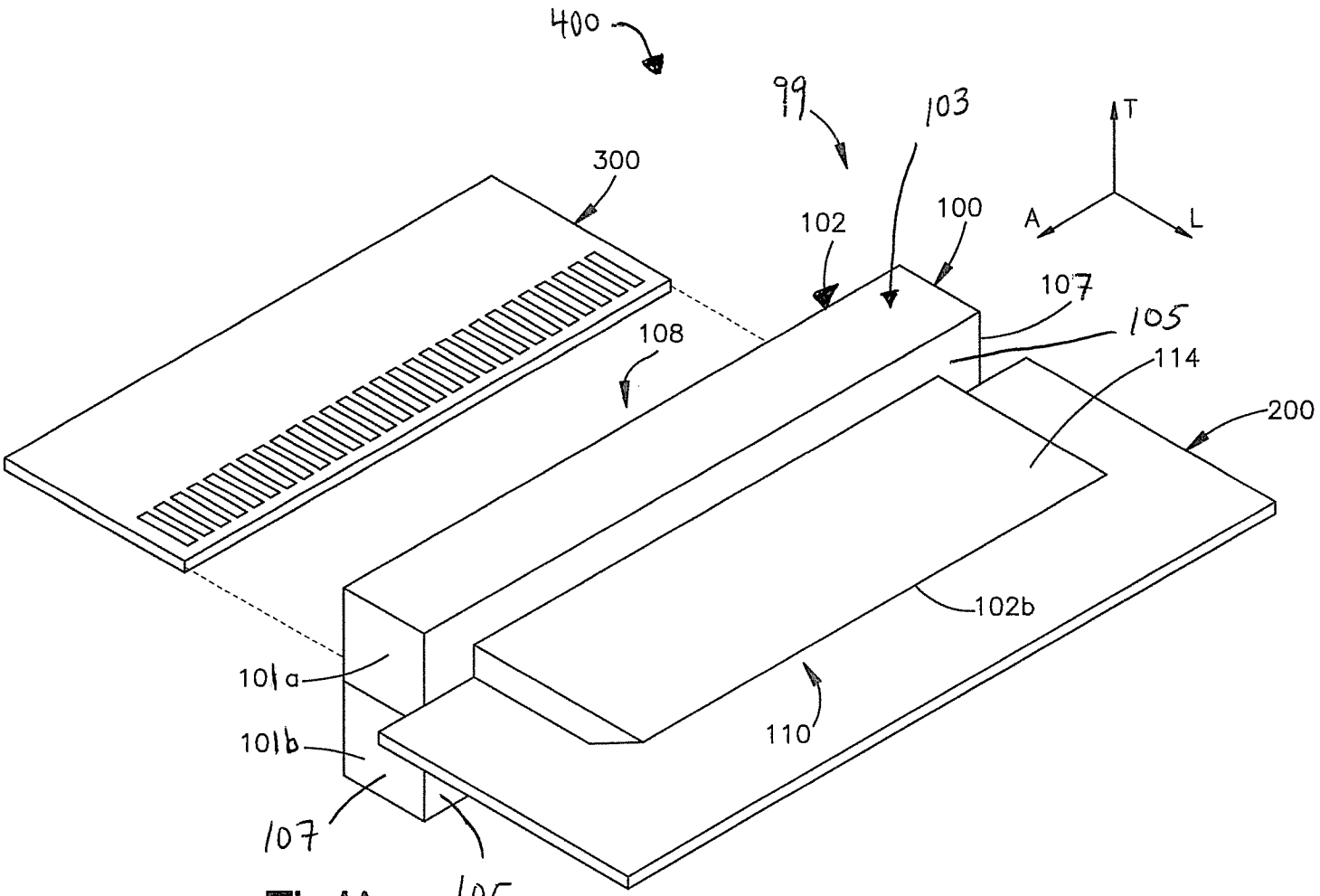
FIG. 1A is a perspective view of an electrical connector assembly that includes a straddle mount electrical connector mounted to a first printed circuit board, wherein the electrical connector assembly is configured to mate with a second printed circuit board in accordance with one embodiment.

For convenience, the same or equivalent elements in the various embodiments illustrated in the drawings have been identified with the same reference numerals. Certain terminology is used in the following description for convenience only and is not limiting. The words "left", "right", "front", "rear", "upper," and "lower" designate directions in the drawings to which reference is made. The words "forward", "forwardly", "rearward", "inner," "inward," "inwardly," "outer," "outward," "outwardly," "upward," "upwardly," "downward," and "downwardly", refer to directions toward and away from, respectively, the geometric center of the object referred to and designated parts thereof. The terminology intended to be non-limiting includes the above-listed words, derivatives thereof and words of similar import.

In accordance with one embodiment, an electrical connector can include a connector housing and at least one plurality of electrical contacts that are supported by the connector housing, and at least one plurality of fusible elements electrically connected to respective ones of the at least one plurality of electrical contacts. The connector housing can define a recess receptacle defines a mounting interface configured to receive a first complementary electrical component, and a mating interface configured to mate with a second complementary electrical component, and can include at least one element support member that can be configured to support the at least one plurality of fusible elements.

In accordance with another embodiment, the connector housing can include a first and second housing. The first and second housing can be constructed substantially the same as each other, for instance as hermaphroditic housings. Each of the first and second housings can support a respective plurality of electrical contacts and can include a respective element support member configured to support a respective plurality of fusible elements. When the first and second housings are attached to one another the first and second housing, and thus the connector housing, can define the mating interface and the element support members can define a receptacle that defines a mounting interface. The respective pluralities of fusible elements can be disposed in the receptacle at the mounting interface.

Referring initially to FIGS. 1A-2B, an electrical connector 100 can be configured to be placed into electrical communication with at least one, such as first and second electrical components, for instance first and second printed circuit boards 200 and 300, respectively. An electrical connector system 400 includes the electrical connector 100 and one or more complementary electrical components, such as the first and second printed circuit boards 200 and 300. As illustrated, the electrical connector assembly 99 includes the first printed circuit board 200 and the electrical connector 100 that is mounted to the first printed circuit board 200. In accordance with the illustrated embodiment, the electrical connector assembly 99 can be removably mated with the second printed circuit board 300 so as to establish an electrical connection between the first printed circuit board 200 and the second printed circuit board 300 via the electrical connector 100.

Figure 1B:
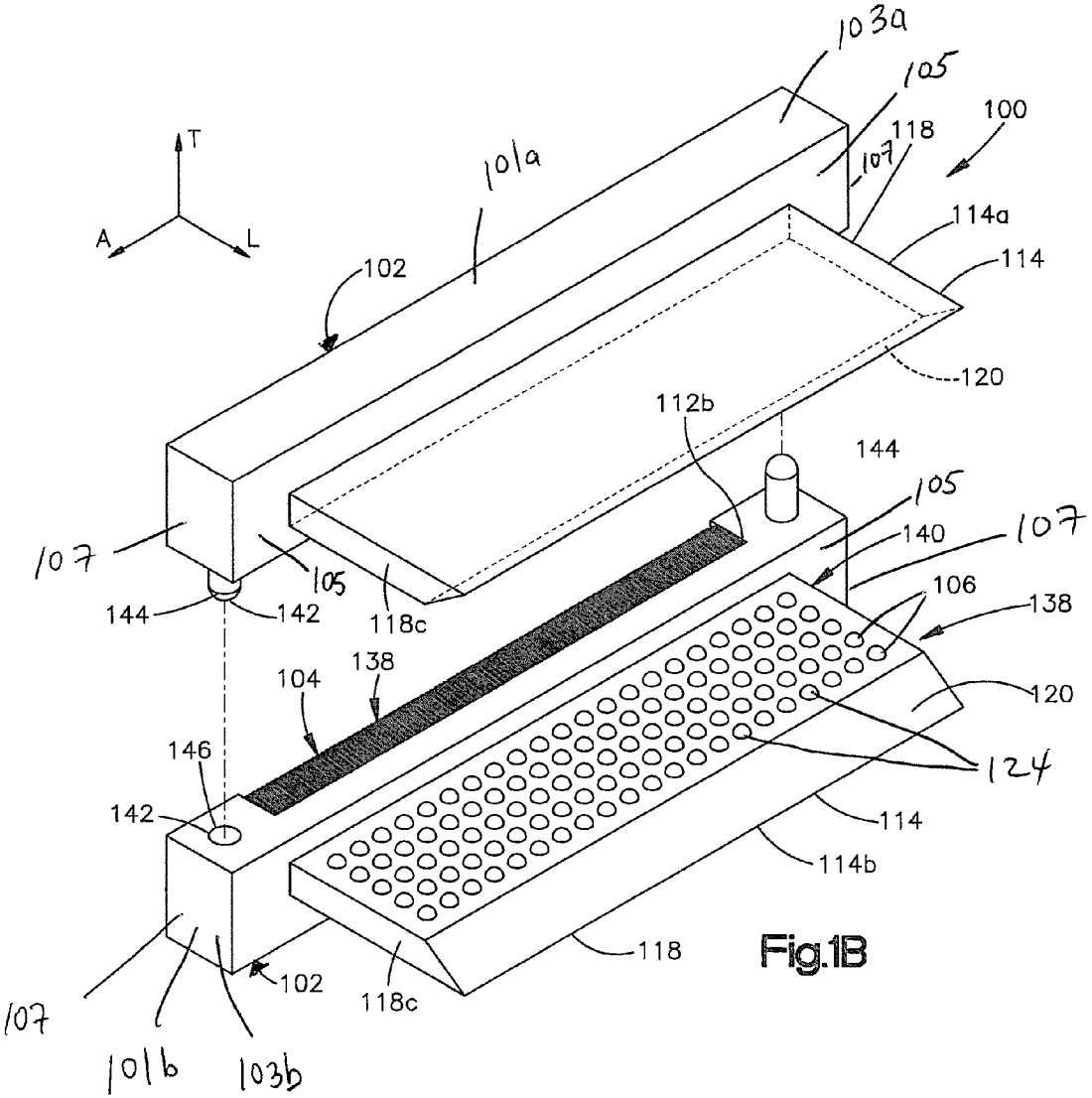
FIG. 1B is a perspective view of the straddle mount electrical connector illustrated in FIG. 1A that includes a connector housing, showing upper and lower housing bodies of the connector housing in an uncoupled position and aligned for coupling.
Figure 1C:
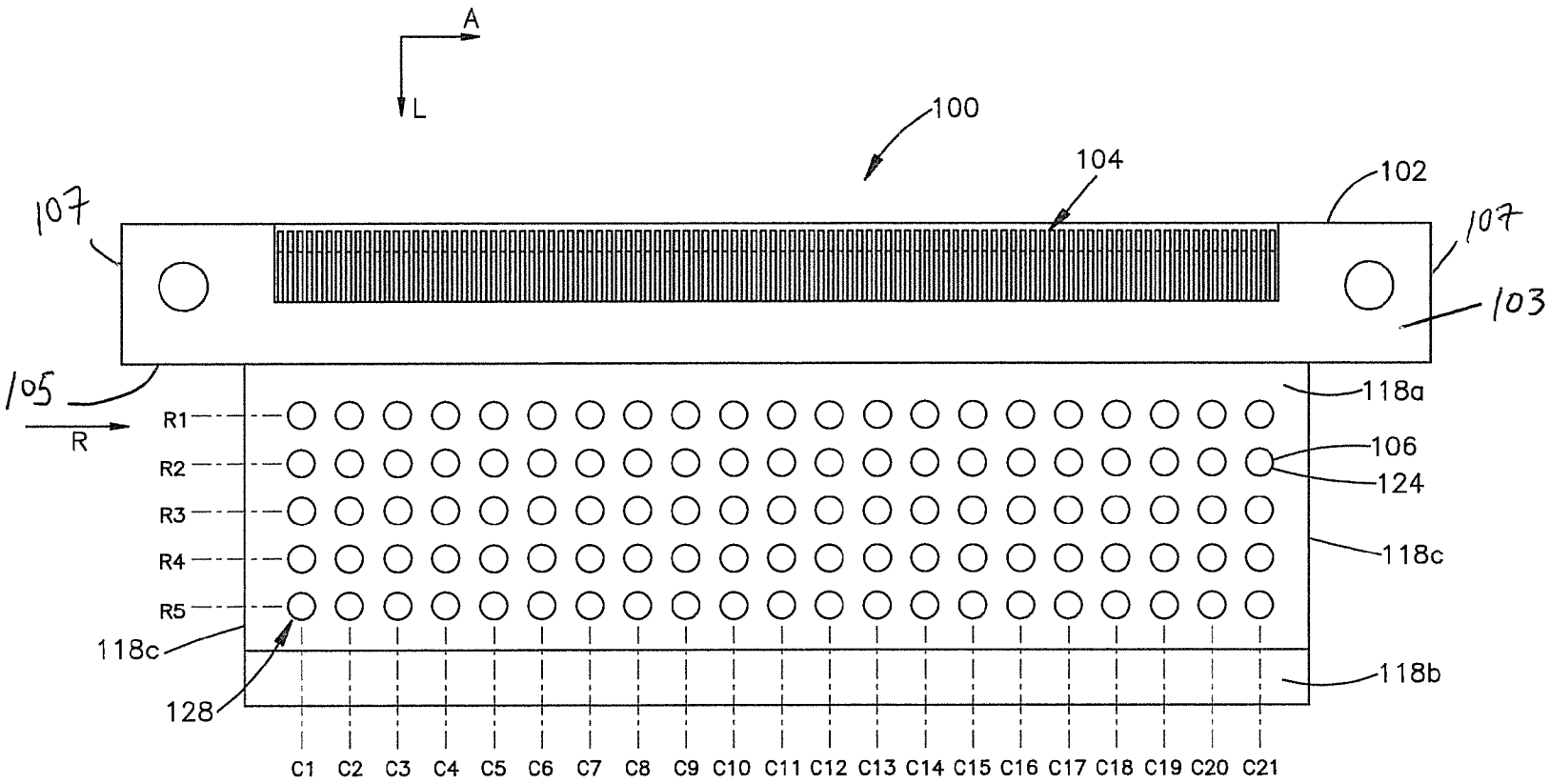
FIG. 1C is a top elevation view of a portion of the electrical connector illustrated in FIG. 1B showing the lower housing body supporting electrical contacts.

With particular reference to FIG. 1B, the electrical connector 100 can include electrical contacts 104 and a connector housing 102 that can be configured to support at least one plurality of the electrical contacts 104, for instance first and second pluralities 134 and 138, respectively, of electrical contacts 104. The electrical connector can further include fusible elements 106 and the connector housing 102 can support at least one plurality of the fusible elements 106, for instance first and second pluralities 136 and 140, respectively, of fusible elements 106. It should be appreciated that the connector housing 102 can be made from any suitable dielectric material unless otherwise specified, and that the electrical contacts 104 and the fusible elements 106 can be made from any suitable conductive material unless otherwise specified. In accordance with the illustrated embodiment, the connector housing 102 can include a first or upper housing 101*a* and a second or lower housing 101*b*. The first housing 101*a* can be coupled with the second housing 101*b* along the transverse direction T. Thus, the connector housing 102 can be configured as a two part connector housing that includes the first and second housings 101*a* and 101*b*, respectively, that can be configured to be attached to each other, for instance along the transverse direction T. The first housing 101*a* can be disposed above the second housing 101*b*, and can be referred to as an upper housing 101*a*, while the second housing 101*b* can be referred to as a lower housing 101*b*. The illustrated first and second housings 101*a* and 101*b*, respectively, can be constructed substantially identically, as hermaphroditic housings.

Various structures are described herein as extending horizontally along a longitudinal direction "L" and a lateral direction "A" that is substantially perpendicular to the longitudinal direction L, and vertically along a transverse direction "T" that is substantially perpendicular to the longitudinal and lateral directions L and A, respectively. As illustrated, the longitudinal direction "L" extends along a forward/rearward direction of the electrical connector 100, and defines a mating direction along which one or both of the electrical connector 100 and the second printed circuit board 300 are moved relative to the other so as to mate the electrical connector 100 with the second printed circuit board 300. Further, as illustrated, the electrical connector 100 can be moved forward in a longitudinal direction L with respect to the first printed circuit board 200 so that at least a portion of the first printed circuit board 200 is received by the electrical connector 100.

Referring again to FIGS. 1A-B, in accordance with the illustrated embodiment, the connector housing 102 can include a housing body 103 and a pair of element support members 114 that extend from the housing body 103 to define a mounting interface 110 that is configured to receive the first printed circuit board 200 along a longitudinal direction L. Thus, the first housing 101*a* can include a first or upper housing body 103*a* and a first or upper element support member 114*a*, and the second housing 101*b* can include a second or lower housing body 103*b* and a second or lower element support member 114*b*. For instance, the connector housing 102 can include a front end 102*a*, which can be defined by the housing body 103, and an opposed back end 102*b*, which can be defined by the element support members 114. The back end 102*b* can be spaced from the front end 102*a* along the longitudinal direction L. The front end 102*a* can generally lie in a plane defined by the transverse and lateral directions T and A, respectively. The front end 102*a*, and thus the housing body 103, can define a mating interface 108 that is configured to be mated with the second printed circuit board 300 so as to place the electrical connector assembly 99 in electrical communication with the second printed circuit board 300. Thus, the connector housing 102 can define a mating interface 108 proximate the front end 102*a* of the electrical connector 100 and a mounting interface 110 proximate the back end 102*b* of the electrical connector 100. Each of the mating and mounting interfaces 108 and 110, respectively, can be configured to receive a respective complementary electrical component, such as the first and second printed circuit boards 200 and 300 which can be inserted relative to the connector housing 102 along a longitudinal direction L.

Referring to FIGS. 1A-2B, the housing body 103 can further define a rear wall 105 that is spaced from the front end 102*a* along the longitudinal direction L, and opposed sides 107 that extend from the front end 102*a* to the rear wall 105 and are spaced from each other along the lateral direction A that is substantially perpendicular to the longitudinal direction L. Thus, the element support members 114 can extend from the rear wall 105 of the housing body 103, and the connector housing 102 can be elongate between the sides 107 along a lateral direction A.

In accordance with the illustrated embodiment, the connector housing 102 can include the pair of opposed element support members 114 that are fixed with respect to the housing body 103. The illustrated element support members 114 are spaced apart from one another along a transverse direction T that is substantially perpendicular to the lateral direction A and the longitudinal direction L. Each of the element support members 114 can be configured to support a respective plurality of fusible elements 106. For example, in accordance with the illustrated embodiment, the connector housing 102 can include the first or upper element support member 114*a* and the second or lower element support member 114*b* that is spaced from the first element support member along the transverse direction T that is substantially perpendicular to both the lateral and longitudinal directions A and L, respectively. It should be appreciated that while the longitudinal and lateral directions are illustrated as extending along a horizontal plane, and that the transverse direction is illustrated as extending along a vertical plane, the planes that encompass the various directions may differ during use, depending, for instance, on the desired orientation of the electrical connector 100.

The connector housing 102 can further define a cavity 112 that extends into the connector housing 102, for instance into the front end 102*a* of the connector housing 102. The cavity 112 can be configured to at least partially support one or more pluralities of electrical contacts 104. For example, in accordance with the illustrated embodiment, the cavity 112 is configured to support mating ends 150 of the electrical contacts 104.

The connector housing 102 can define a receptacle 116 at the mounting interface 110, and the receptacle 116 can be configured to receive a complementary electrical component, such as the first printed circuit board 200. The receptacle 116 can define the mounting interface 110. For example, in accordance with the illustrated embodiment the first and second element support members 114*a* and 114*b*, respectively, can be spaced from one another such that the receptacle 116 is defined therebetween at the mounting interface 110. The receptacle can be configured to receive the first printed circuit board 200. Each of the illustrated element support members 114 can have a substantially rectangular shaped body 118 that defines a proximal end 118*a* that extends from the rear wall 105 and a free distal end 118*b* that is spaced from the proximal end 118*a* along the longitudinal direction L. The respective body 118 of the element support members 114 can further define opposed sides 118*c* that are spaced apart from each along the lateral direction A, an inner surface 118*d* that can be configured to support a respective plurality of fusible elements 106, and an outer surface 118*e* that is spaced from the inner surface 118*d* along the transverse direction T. Thus, the inner surface 118*d* of the first element support member 114*a* can face the inner surface 118*d* of the second element support member 114*b* to define the receptacle 116, such that the inner surfaces 118*d* of the illustrated electrical connector 100 can also be referred to as facing surfaces 118*d*. Thus, the first element support member 114*a* can define a first inner surface 118*d* and the second element support member 114*b* can define a second inner surface 118*d* that the first inner surface 118*d* so as to define the receptacle 116 therebetween, and the first and second pluralities 136 and 140 of fusible elements 106 can be carried by the first and second inner surfaces 118*d*, respectively. Further, the first and second pluralities 136 and 140 of fusible elements can be disposed at least partially in the first and second inner surfaces 118*d*, respectively.

The illustrated element support members 114 are elongate along the lateral direction A between their respective sides 118*c*. The distal end 118*b* of each element support member 114 can define a leading edge 120 that can be configured to guide a complementary electrical component, such as the first printed circuit board 200, into the receptacle 116 when the first printed circuit board 200 is inserted into the electrical connector 100. For instance, the leading edges 120 of the illustrated element support members 114 can be configured as beveled edges having surfaces that are angularly offset relative to the longitudinal direction L. As illustrated, the leading edge 120 of one element support member 114 can mirror that of the opposed element support member 114.

The first and second housings 101*a* and 101*b*, respectively, can define a respective portion of the cavity 112, and can include the first and second element support members 114*a* and 114*b*, respectively. In accordance with the illustrated embodiment, the first housing 101*a* includes the first element support member 114*a* and defines an upper or first cavity portion 112*a* that is configured to support the first plurality 134 of electrical contacts 104. The second housing 101*b* includes the second element support member 114*b* and can define a lower or second cavity portion 112*b* that is configured to support the second plurality 140 of electrical contacts 104. The first element support member 114*a* can be configured to support the first plurality 136 of fusible elements 106, and the second element support member 114*b* can be configured to support the second plurality 140 of fusible elements 106. The first and the second pluralities 136 and 140 of the fusible elements 106 can be fused to opposite sides of the printed circuit board 200 when the printed circuit board 200 is in a mounted position with the electrical connector 100 (see FIG. 1A). In accordance with the illustrated embodiment, when the first and second housings 101*a* and 101*b* are attached to each other the first and second element support members 114*a* and 114*b* are fixed with respect to each other and with respect to the housing body 103.

Figure 2A:
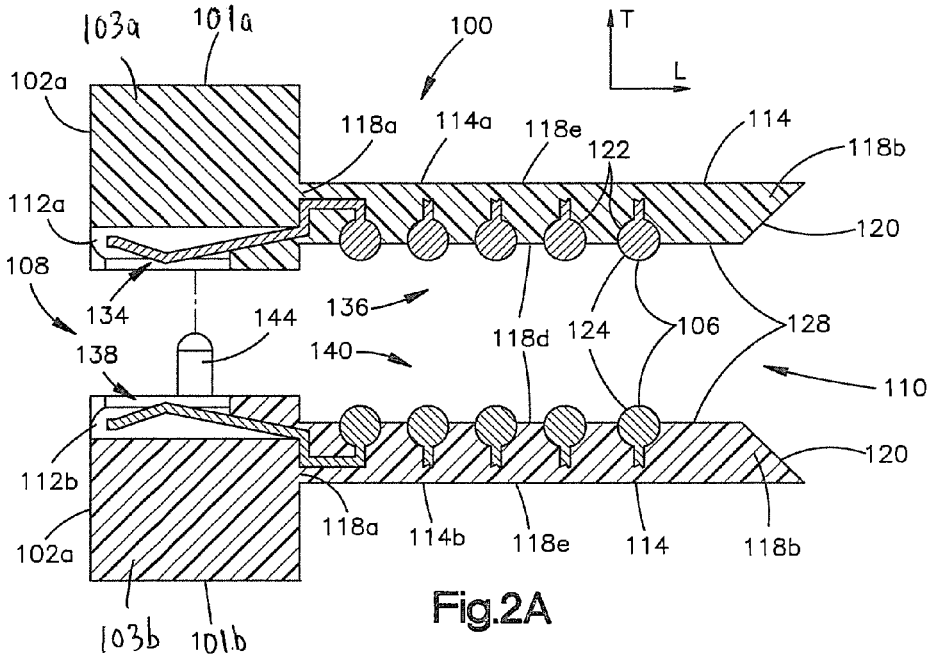
FIG. 2A is a side section view of the electrical connector illustrated in FIG. 1B showing the upper and lower housing bodies in an uncoupled position.
Figure 2B:
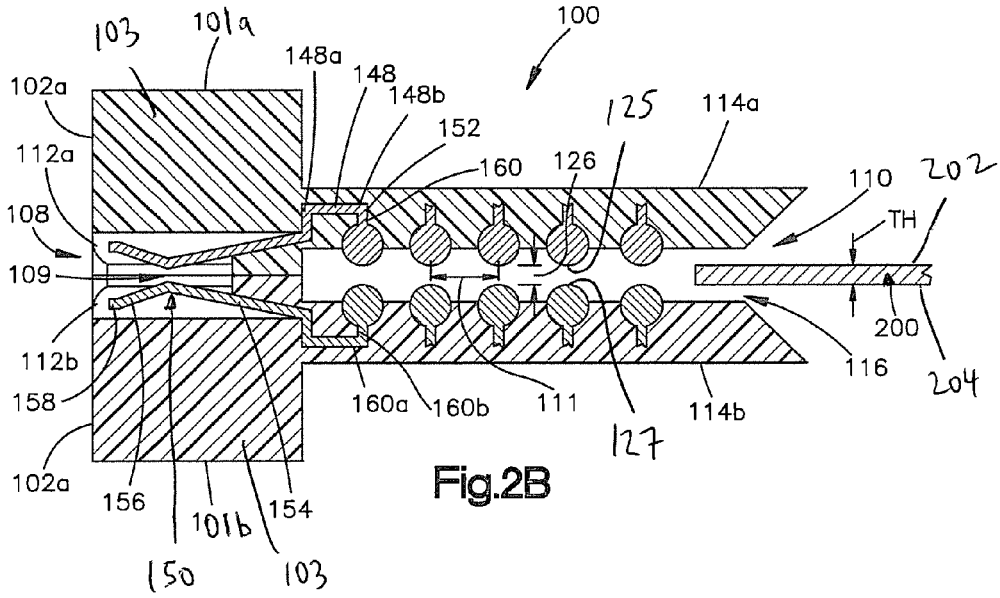
FIG. 2B is another side section view of the electrical connector illustrated in FIG. 1B with the upper and lower housing bodies in a coupled position, showing the second printed circuit board illustrated in FIG. 1A aligned to be received by the straddle mount electrical connector.

With particular reference to FIGS. 2A-B, the first and second element support members 114*a* and 114*b* can at least partially support the first and second pluralities 134 and 138, respectively, of electrical contacts 104 and can further support the first and second pluralities 136 and 140 of fusible elements 106. The fusible elements 106 can be disposed at least partially between the inner surfaces 118*d* of the element support members 114. For example, in accordance with the illustrated embodiment, the fusible elements 106 can be disposed at least partially in the inner surfaces 118*d* of the respective element support members 114, such that each fusible element 106 is supported by the inner surface 118*d* of a respective one of the element support members 114. The first and second inner surfaces 118*d* of the element support members 114 can define respective first and second pluralities of recesses 122 therein. The recesses 122 can be configured to receive at least a portion of a respective one of the fusible elements 106. Thus, the fusible elements 106 of the first and second pluralities 136 and 140 of fusible elements 106 can be disposed in the first and second pluralities of recesses 122, respectively. Alternatively, fusible elements 106 can be suspended relative to a respective one of the recesses 122, as described in more detail below.

Figure 3A:
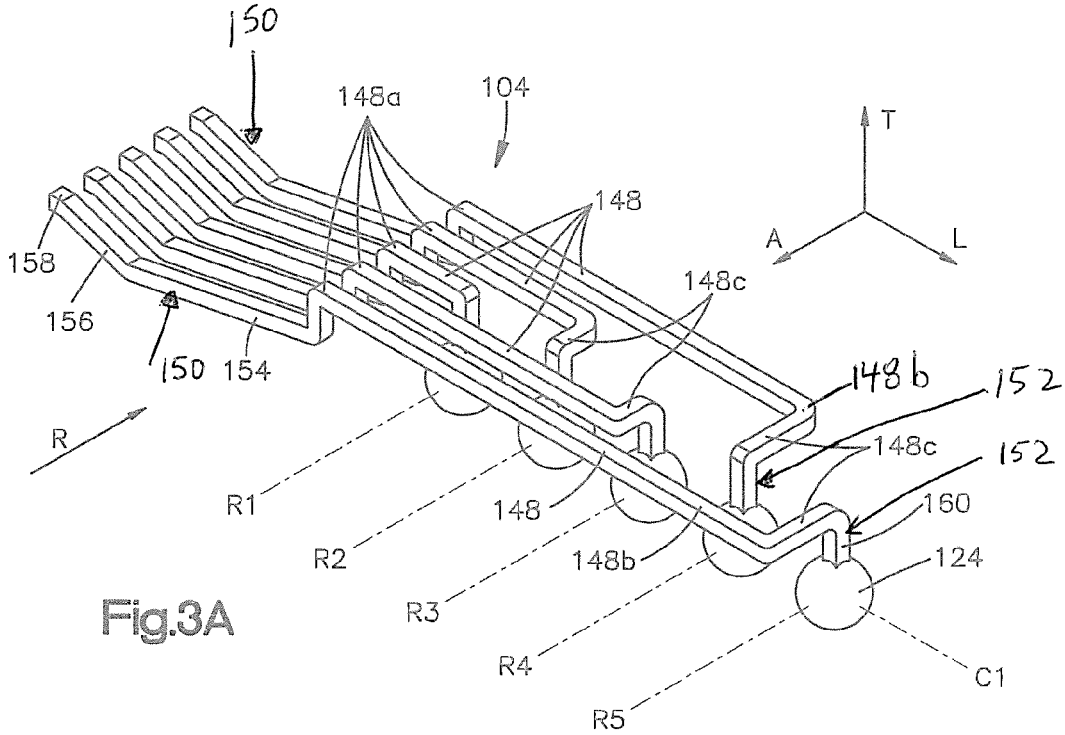
FIG. 3A is a perspective view of a row of electrical contacts and a column of fusible elements electrically connected to the electrical contacts, constructed in accordance with one embodiment.
Figure 3B:
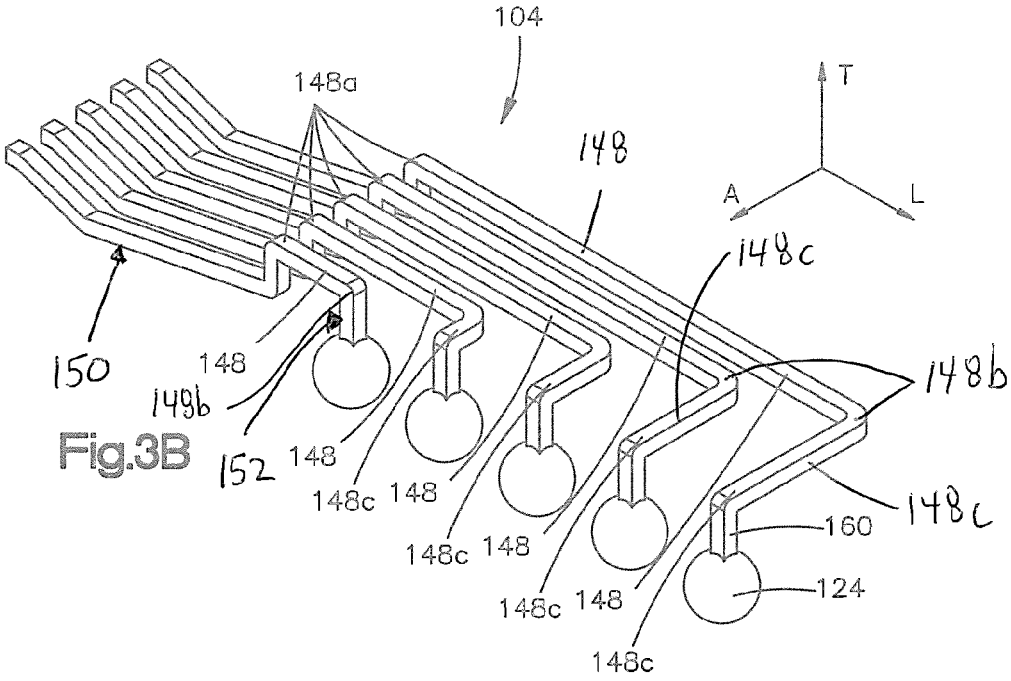
FIG. 3B is a perspective view of a row of electrical contacts and a column of fusible elements electrically connected to the electrical contacts, constructed in accordance with an alternative embodiment.

Referring also to FIGS. 3A-B, in accordance with the illustrated embodiment, the fusible elements can be configured as solder balls 124, and thus the electrical connector 100 can include first and second pluralities 136 and 140, respectively, of solder balls 124. The inner surfaces 118*d* of the element support members 114 can define respective first and second pluralities of semi-spherical recesses 122 that can be configured to at least partially receive a corresponding solder ball 124. Each solder ball 124 can be disposed in a respective recess 122 of the first and second pluralities of recesses 122. It should be appreciated that the electrical connector 100 is not limited to fusible elements 106 in the form of the illustrated solder balls 124, and that the electrical connector 100 can be alternatively provided with any other suitable fusible elements 106 as desired.

Figure 4:
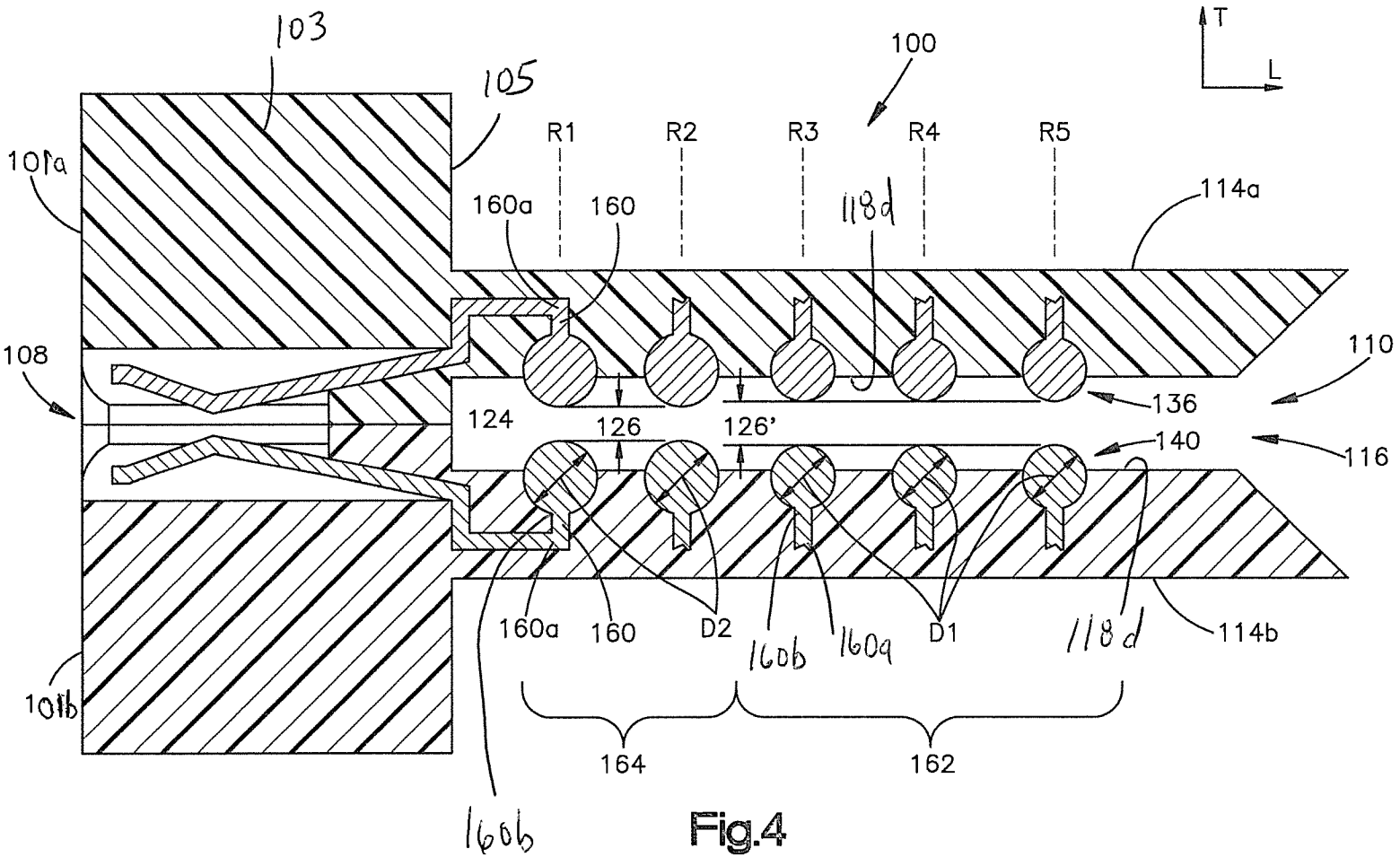
FIG. 4 is a side section view of a straddle mount electrical connector that includes fusible elements having various sizes in accordance with an alternative embodiment.

Referring to FIGS. 2B and 4, the solder balls 124 that are supported by the first element support member 114*a*, and thus the first plurality 136 of fusible elements 106 that are supported by the first element support member 114*a*, can define a lowermost surface 125 that faces the inner surface 118*d* of the second element support member 114*b*. Similarly, the solder balls 124 that are supported by the second element support member 114*b*, and thus the second plurality 140 fusible elements 106 that are supported by the second element support member 114*b*, can define an uppermost surface 127 that faces the inner surface 118*d* of the first element support member 114*a*. Thus, the lowermost surface 125 of the fusible element 106 that is supported by the first element support member 114*a* can face an opposed uppermost surface 127 of the respective fusible element 106 that is supported by the second element support member 114*b* and can be spaced from the opposed uppermost surface 127 a solder ball spacing distance 126 along a select direction, which can be the transverse direction T. The solder balls 124 that are supported by the first element support member 114*a* can define the first plurality 136, and the solder balls 124 that are supported by the second element support member 114*b* can define the second plurality 140. The solder ball spacing distance 126 can be measured along the transverse direction T between a first tangential plane defined along the lowermost surfaces 125 of the first plurality 136 of solder balls 124 and a second tangential plane defined along the uppermost surfaces 127 of the second plurality 140 of solder balls 124. Thus, the solder ball spacing distance 126 can be defined along the transverse direction T between a location on the surface of each solder ball 124 supported by a first one of the element support members 114 that is closest to that of an opposed solder ball 124 supported by the other of the element support members 114. The fusible elements 106 can be configured to move as the first printed circuit board 200 is received in the receptacle 116 of the electrical connector 100 so as to increase the spacing distance 126.

The recesses 122 can define a depth that can be increased or reduced to define the solder ball spacing distance 126. Alternatively, the solder balls 124 can define a cross-sectional dimension, such as a diameter, that defines the solder ball spacing distance 126. In yet another embodiment, the solder ball spacing distance 126 can be defined by spacing the element support members 114 apart from each other a predetermined distance along the transverse direction T. It will be understood the solder ball spacing distance 126 can be varied as desired. For instance, the solder ball spacing distance 126 can be varied by altering the cross-sectional dimensions of the solder balls 124, by increasing or decreasing the depth of the recesses 122, by varying the predetermined distance that the element support members 114 are apart from each along the transverse direction T, or any combination thereof.

Referring to FIG. 2B, the first printed circuit board 200 can define a first or upper surface 202 and a second or lower surface 204 that is spaced from the upper surface 202 along the transverse direction T. In accordance with the illustrated embodiment, the upper surface 202 can be configured to move along the first plurality 136 of fusible elements 106 that are supported by first element support member 114*a* as the first printed circuit board 200 is received by the electrical connector 100 along the longitudinal direction L, and the lower surface 204 can be configured to move along the second plurality 140 of the fusible elements 106 that are supported by the second element support member 114*b* as the first printed circuit board 200 is received by the electrical connector 100 along the longitudinal direction L. The upper surface 202 and the lower surface 204 can define a predetermined thickness TH that can be measured between the upper and lower surfaces 202 and 204, respectively, along the transverse direction T. For instance, the cross-sectional dimensions of the solder balls 124 and the recesses 122 can be sized to define a desired solder ball spacing distance 126 that is substantially equal to the predetermined thickness TH of the first printed circuit board 200.

In accordance with the illustrated embodiment, the element support members 114 can be oriented substantially parallel relative to one another, such that the distance between the facing inner surfaces 118*d* along the transverse distance T is substantially uniform. Thus, the first and second inner surfaces 118*d* can be substantially parallel with respect to each other. The solder balls 124 of the first and second pluralities 136 and 140, respectively, can define planar arrays 128 of solder balls 124 relative to their respective element support members 114. The solder balls 124 of the illustrated electrical connector 100 can have substantially the same cross-sectional dimension as each for other, for instance substantially the same diameter as each other, and the recesses 122 of each element support member 114 can be sized substantially equally, such that the arrays 128 are substantially parallel relative to each other and substantially parallel with respect to a plane defined along the longitudinal and lateral directions L and A, respectively, when solder balls of the first and second pluralities are disposed in respective ones of the first and second pluralities of recesses 122.

The recesses 122 can be distributed across the respective inner surfaces 118*d* of each element support member 114 such that the solder balls 124 of each array 128 align with a corresponding contact pad affixed to the first printed circuit board 200 when the printed circuit board is fully inserted into the receptacle 116. The recesses 122, and thus the solder balls 124, can be arranged in at least one, such as a plurality rows that are spaced apart along the longitudinal direction L. The recesses 122, and thus the solder balls 124, can be arranged in at least one, such as plurality of columns that are spaced apart along the lateral direction A. For instance, in accordance with the illustrated embodiment, the array 128 of solder balls 124 includes five rows R1-R5 of solder balls 124 disposed along a row direction R that is substantially equal to the lateral direction A. Alternatively, the array 128 can comprise more or fewer rows of solder balls 124 that are equally or unequally spaced apart from one another. The illustrated rows of solder balls 124 are substantially equally spaced apart from one another along the longitudinal direction L, between the proximal end 118*a* and the distal end 118*b* of the body 118. The illustrated array 128 of solder balls 124 can further include twenty one columns C1-C21 of solder balls 124 disposed along a column direction C that is equal to the longitudinal direction L. The illustrated columns of solder balls 124 are substantially equally spaced apart from one another along the lateral direction A, between the sides 118*c* of the body 118. Alternatively, the array 128 can comprise more or fewer columns of solder balls 124 that are equally or unequally spaced apart from one another. It should be appreciated that the electrical connector 100 is not limited to the illustrated array 128 and that the fusible elements 106 of the electrical connector 100 can alternatively be arranged in any other suitable pattern along the inner surfaces 118*d* of the element support members 114.

The first and second element support members 114*a* and 114*b*, respectively, can be integral and monolithic with the respective first and second housing bodies 103*a* and 103*b*. Accordingly, the first and second element support members 114*a* and 114*b* can be fixed with respect to each other when the first housing 101*a* is coupled to the second housing 101*b*. Alternatively, the first and second element support members 114*a* and 114*b* can be separately constructed and attached to the first housing body 103*a* and the second housing body, respectively, such that the first and second element support members 114*a* and 114*b* are fixed with respect to each other when the first housing 101*a* is attached to the second housing 101*b*. The first and second pluralities 136 and 140 of fusible elements 106 can be arranged into respective arrays 128 as described above. The respective arrays 128 of the upper and lower element support members 114*a* and 114*b* can be arranged the same as each other or different from each other, for instance in accordance with corresponding contact pads affixed to the first and second surfaces 202 and 204 of the first printed circuit board 200.

The upper and lower housings 101*a* and 101*b* can be configured to be attached to one another. In accordance with the illustrated embodiment, the housing bodies 103*a* and 103*b*, and thus the housings 101*a* and 101*b*, can define at least one, such as a respective pair of attachment members 142. The attachment members 142 of the first housing 101*a* can be configured to engage with complementary attachment members 142 of the second housing 101*b* when the first and second housings 101*a* and 101*b* are mated, thereby attaching the first and second housings 101*a* and 101*b* to one another, such that the first and second housings 101*a* and 101*b* are fixed in place with respect to each other. In accordance with the illustrated embodiment, each of the illustrated housings 101*a* and 101*b* can define one attachment member 142 in the form of a post 144 and one attachment member 142 in the form of an aperture 146. The post 144 of the first housing 101*a* is disposed proximate to the side 107, which is the same side 107 in which the aperture 146 of the second housing 101*b* is proximately disposed. The aperture 146 of the first housing 101*a* is disposed proximate to the opposite side 107 that the post 144 of the first housing 101*a* is disposed. The aperture 146 of the first housing 101*a* is disposed proximate to the side 107 that is the same side 107 in which post 144 of the second housing 101*b* is proximately disposed. It will be understood that the posts 144 and apertures 146 can be defined at any other suitable locations on the housings 101*a* and 101*b* as desired.

The aperture 146 of each of the housings 101*a* and 101*b* can be sized to receive the post 144 of the other of the housings 101*a* and 101*b* in a press fit engagement within the aperture 146. Accordingly, when the first and second housings 101*a* and 101*b* are mated to each other, the post 144 of the first housing 101*a* is received in the aperture 146 of the second housing 101*b* and the post 144 of the second housing 101*b* is received in the aperture 146 of the first housing 101*a*. It should be appreciated that the housings 101*a* and 101*b* are not limited to the illustrated attachment members 142, and that the housings 101*a* and 101*b* can be alternatively constructed with any other suitable attachment members that facilitate mating the housings to one another. It should further be appreciated that the electrical connector 100 is not limited to the illustrated two part connector housing 102, and that the connector housing 102 can alternatively be constructed having a one piece, or monolithic housing. Thus, it should be appreciated that the first housing body 103*a* can be attached to the second housing body 103*b*, for instance as described herein, or the first housing body 103*a* can be monolithic with the second housing body 103*b* as desired.

Referring now to FIGS. 2A-3B, the connector housing 102 can be overmolded onto the electrical contacts 104. For instance, the first housing body 103*a* and the first element support member 114*a*, and thus the first housing 101*a*, can be overmolded onto the first plurality 134 of electrical contacts 104. Similarly, the second housing body 103*b* and the second element support member 114*b*, and thus the second housing 101*b*, can be overmolded onto the second plurality 138 of electrical contacts 104. Alternatively, the electrical contacts 104 can be stitched into the connector housing 102, or otherwise attached to the connector housing 102, as desired.

The electrical contacts 104 of the first and second pluralities 134 and 138, respectively, can be constructed substantially identically. The electrical contacts 104 can include a respective mounting end 152 and a respective intermediate body portion 148 that extends between the mounting end 152 and the mating end 150 that is configured to electrically connect to a complementary electrical component, such as the second printed circuit board 300. For instance, the first plurality 134 of electrical contacts 104 supported by the connector housing 102 can define respective first mating ends 150 that are configured to electrically connect to the second printed circuit board 300, and a plurality of first mounting ends 152 that can be configured to mount to respective contact pads of a complementary electrical component so that the fusible elements 106 can fuse the mounting ends 152 to the contact pads. The mounting ends 152 can be configured to mount to the first printed circuit board 200 when the first printed circuit board is received in the receptacle 116. The first and second mating ends 150 can be spaced apart so as to receive the second printed circuit board 300 therebetween, such that the first mating ends 150 electrically connect to a first side of the second printed circuit board 300, and the second mating ends 150 electrically connect to a second side of the second printed circuit board 300 that is opposite the first side of the second printed circuit board 300. Thus, the second plurality 140 of fusible elements 106 can be spaced from the first plurality 136 of fusible elements 106 along a select direction, which can be the transverse direction T, so as to define the spacing distance 126 therebetween, and the second plurality of mating ends 150 can be spaced from the first plurality of mating ends 150 along the select direction.

The first plurality 136 of fusible elements 106 can be supported by respective ones of the first mounting ends 152 and can be in electrical communication with respective ones of the first mating ends 150, and each of the first plurality 134 of fusible elements 106 that are supported by the first element support member 114*a* can be configured to be fused to the first side 202 of the first printed circuit board 200. The second plurality 138 of electrical contacts 104 supported by the connector housing 102 can define respective second mating ends 150 that are configured to electrically connect to the second printed circuit board 300, and a plurality of second mounting ends 152. The second plurality 140 of fusible elements 106 can be supported by respective ones of the second mounting ends 152 and can be in electrical communication with respective ones of the second mating ends 150, and each of the second plurality 138 of fusible elements 106 that are supported by the second element support member 114*b* can be configured to be fused to the second side 204 of the first printed circuit board 200. Thus, the first plurality 136 of fusible elements 106 and the second plurality 140 of fusible elements 106 are configured to fuse to opposed surfaces of the first printed circuit board 200 such that an electrical connection is established between the first printed circuit board 200 and the second printed circuit board 300 when the electrical connector 100 is mated with the second printed circuit board 300.

The mating end 150 can be defined at a proximal end 148*a* of the intermediate body portion 148 and the mounting end 152 can be defined at an opposed distal end 148*b* of the intermediate body portion 148. The mounting end 152 can be configured to support a respective fusible element 106. The fusible element 106 can be integral with the mounting end 152, and thus with the electrical contact 104. For instance, the first plurality 136 of fusible elements 106 can be integral with a respective one of the first plurality 134 of electrical contacts 104, and the second plurality 140 of fusible elements 106 can be integral with a respective one of the second plurality 138 of electrical contacts 104. Alternatively, the fusible element 106 can be constructed separately from the electrical contact 104 and attached thereto.

In accordance with the illustrated embodiment, the mating end 150 of each electrical contact 104 can define an inwardly flaring portion 154 that extends in the longitudinal direction L from the proximal end 148*a* and transversely upward toward a midplane defined along the longitudinal and lateral directions L and A, respectively. The midplane can be defined between the upper and lower housings 101*b* and 101*b*. The mating end 150 can further define an outwardly flaring portion 156 that extends longitudinally forward from the inwardly flaring portion 154 and transversely downward from the midplane. The mating end 150 can further define a mating terminal end 158 that extends longitudinally forward from the outwardly flaring portion 156 along a direction substantially parallel to the midplane, although the mating terminal end 158 can curve inward or outward relative to the midplane as desired.

When the electrical contacts 104 of the first plurality 134 of electrical contacts 104 are disposed in the upper housing 101*a* and aligned along the transverse direction T with corresponding electrical contacts 104 of the second plurality 138 of electrical contacts 104 that are disposed in the lower housing 101*b*, the inwardly flaring portions 154 of the first and second pluralities 134 and 138 can be configured to flare towards each other along a forward direction, but not abut each other, and the outwardly flaring portions 156 can be configured to flare away from each other further along the forward direction. Thus, the electrical contacts 104 can defining a respective contact receiving space 109, and the contact receiving space 109 can be configured to receive an electrical contact of a complementary electrical component, for instance respective contact pads affixed to the upper and/or lower surfaces of the second printed circuit board 300, a blade contact of an electrical header connector, or the like. Accordingly, the electrical contacts 104 can be referred to as receptacle contacts.

With particular reference to FIG. 4, as illustrated, the mounting end 152 of each electrical contact 104 can define a solder tail 160 that can extend transversely inward relative to distal end 148*b* of the intermediate body portion 148, for instance toward the midplane between the upper and lower housing 101*a* and 101*b*. The solder tail 160 can support a respective fusible element 106. In accordance with the illustrated embodiment, each solder ball 124 can be supported by the mounting end 152 of a respective electrical contacts 104, such that the solder ball 124 is in electrical communication with a mating end 150 of the respective electrical contact 104.

The solder balls 124 can be integral with the respective mounting ends 152. Alternatively, the solder balls 124 can be constructed separately from the electrical contacts 104 and attached thereto. The solder tails 160 can define a proximal end 160*a* that is disposed proximate to the respective intermediate body portion 148 of the respective solder tail 160, and a distal end 160*b* that is opposite the proximal end 160*a* along the transverse direction T. In accordance with the illustrated embodiment, each solder ball 124 can be attached to a distal end 160*b* of the solder tail 160.

Referring in to FIG. 2B, a distance as measured between the lowermost surfaces 125 of adjacent fusible elements 106 of the first plurality 136 along the longitudinal direction L can define a contact receiving space 111. Similarly, a distance as measured between the uppermost surfaces 127 of adjacent fusible elements 106 of the second plurality 140 along the longitudinal direction L can define the contact receiving space 111. The contact receiving space 111 can be configured to receive an electrical contact of a complementary electrical component, for instance respective contact pads can be affixed to the upper and lower surfaces 202 and 204 of the first printed circuit board 200.

Because the mounting interface 110 of the illustrated electrical connector 100 is oriented substantially parallel with respect to the mating interface 108, the electrical connector 100 can be referred to as a vertical electrical connector. It should be appreciated that the electrical contacts 104 can be alternatively constructed so as to define a mounting interface 110 that is oriented substantially perpendicular to the mating interface 108, such that the electrical connector 100 is provided as a right-angle electrical connector.

Referring now to FIGS. 3A-B, the intermediate portions 148 of the electrical contacts 104 can be constructed with varying geometries, for instance in accordance with the desired arrangement of the solder balls 124 within an array 128. For example, five solder balls arranged into a column C1 are depicted in FIG. 3A. Each solder ball 124 of the column C1 can further be a member of a respective row R1-R5 of solder balls 124. The column C1 can be a member of an array 128 of solder balls 124, such as the array 128 illustrated in FIG. 1C. Each of the illustrated solder balls 124 is connected to the solder tail 160 of a respective one of five electrical contacts 104. In accordance with the illustrated embodiment, the electrical contact 104 connected to the solder ball 124 in the R1, C1 position within the array 128 has an intermediate portion 148 that extends parallel to the longitudinal direction L between the proximal and distal ends 148*a* and 148*b*, respectively. The electrical contacts 104 connected to the solder balls 124 in the R3, C1 and R5, C1 positions within the array 128 have intermediate body portions 148 that extend parallel to the longitudinal direction L between the proximal and distal ends 148*a* and 148*b*, respectively. The electrical contacts 104 can further define laterally offset portions 148*c* between the distal ends 148*b* and the solder tails 160, such that the intermediate body portions 148 are offset to the left with respect to the column C1. The electrical contacts 104 connected to the solder balls 124 in the R2, C1 and R4, C1 positions within the array 128 have intermediate body portions 148 that extend parallel to the longitudinal direction L between the proximal and distal ends 148*a* and 148*b*, and the contacts 104 can define laterally offset portions 148*c* between the distal ends 148*b* and the solder tails 160, such that the intermediate body portions 148 are offset to the right with respect to the column C1. The lengths of the respective offset portions 148*c* can be configured such that the mating ends 150 of the electrical contacts 104 are spaced apart from each other substantially equally along the row direction R.

The configuration of the electrical contacts 104 illustrated in FIG. 3A can be repeated for adjacent columns of solder balls 124 of the array 128. For instance, the electrical contacts 104 connected to the solder balls 124 of the second column C2 of solder balls 124 that is disposed adjacent the first column C1 of solder balls 124 in the array 128 (see FIG. 1C) can be constructed identically to those connected to the solder balls 124 of column C1, and so on.

An alternative configuration of electrical contacts 104 is illustrated in FIG. 3B. In accordance with the illustrated embodiment, the electrical contact 104 connected to the solder ball 124 in the R1, C1 position within the array 128 has an intermediate portion 148 that extends parallel to the longitudinal direction L between the proximal and distal ends 148*a* and 148*b*. The electrical contacts 104 connected to the solder balls 124 in the R2, C1, R3, C1, R4, C1, and R5, C1 positions within the array 128 have intermediate body portions 148 that extend parallel to the longitudinal direction L between the proximal and distal ends 148*a* and 148*b*, and define laterally offset portions 148*c* between the distal ends 148*b* and the solder tails 160, such that the intermediate portion 148 of each electrical contact 104 is offset to the right with respect to the column C1. The length of the offset portions 148*c* of each successive electrical contact 104 is greater than that of the previous electrical contact, moving laterally from left to right. The electrical contacts 104 can alternatively be constructed such that the intermediate portion 148 of each of the electrical contacts 104 connected to the solder balls 124 in the R2, C1, R3, C1, R4, C1, and R5, C1 positions within the array 128 is offset to the left with respect to the column C1. It should be appreciated that the electrical contacts 104 are not limited to the configurations illustrated in FIGS. 3A-B, and that the electrical contacts 104 can be alternatively constructed with any other suitable geometries as desired.

Referring again to FIGS. 1A-2B, the electrical connector 100 can be straddle mounted onto a complementary electrical component, such as the first printed circuit board 200. In accordance with the illustrated embodiment, a leading edge of the first printed circuit board 200 can be inserted into the receptacle 116 of the electrical connector 100, such that the element support members 114 straddle the first printed circuit board 200. The first printed circuit board 200 can be advanced into an aligned position relative to the mounting interface 110 such that the solder balls 124 of the first plurality 136 abut contact pads affixed to the upper surface 202 of the first printed circuit board 200 and the solder balls 124 of the second plurality 140 abut contact pads affixed to the lower surface 204 of the first printed circuit board 200. When the first and second pluralities 136 and 140 of solder balls 124 are aligned with respective contact pads of the first printed circuit board 200, the electrical connector assembly 99 that includes the electrical connector 100 and the first printed circuit board 200 can be exposed to heat sufficient to cause the solder of the solder balls 124 of the first and second pluralities 136 and 140 to reflow, thereby creating electrical connections between the electrical contacts 104 of the first and second pluralities 134 and 138 of electrical contacts 104 and the respective contact pads that are affixed to the first printed circuit board 200. It should be appreciated that additional circuit board components can be positioned at respective locations on the first printed circuit board 200 and mounted to the first printed circuit board 200 as part of the same reflow process that mounts the first printed circuit board 200 to the electrical connector 100.

Once the first printed circuit board 200 is mounted to the electrical connector 100, a complementary electrical component, such as the second printed circuit board 300, can be coupled to the electrical connector 100. For example, the second printed circuit board 300 can be inserted into the cavity 112 and advanced into an aligned position relative to the mating interface 108 such that the mating ends 150 of the electrical contacts 104 of the first plurality 134 abut contact pads affixed to an upper surface of the second printed circuit board 300 and the mating ends 150 of the electrical contacts 104 of the second plurality 138 abut contact pads affixed to a lower surface of the second printed circuit board 300. Inserting the second printed circuit board 300 into position relative to the mating interface 108 can place the second printed circuit board 300 into electrical communication with the first printed circuit board 200, via the electrical connector 100.

Figure 5:
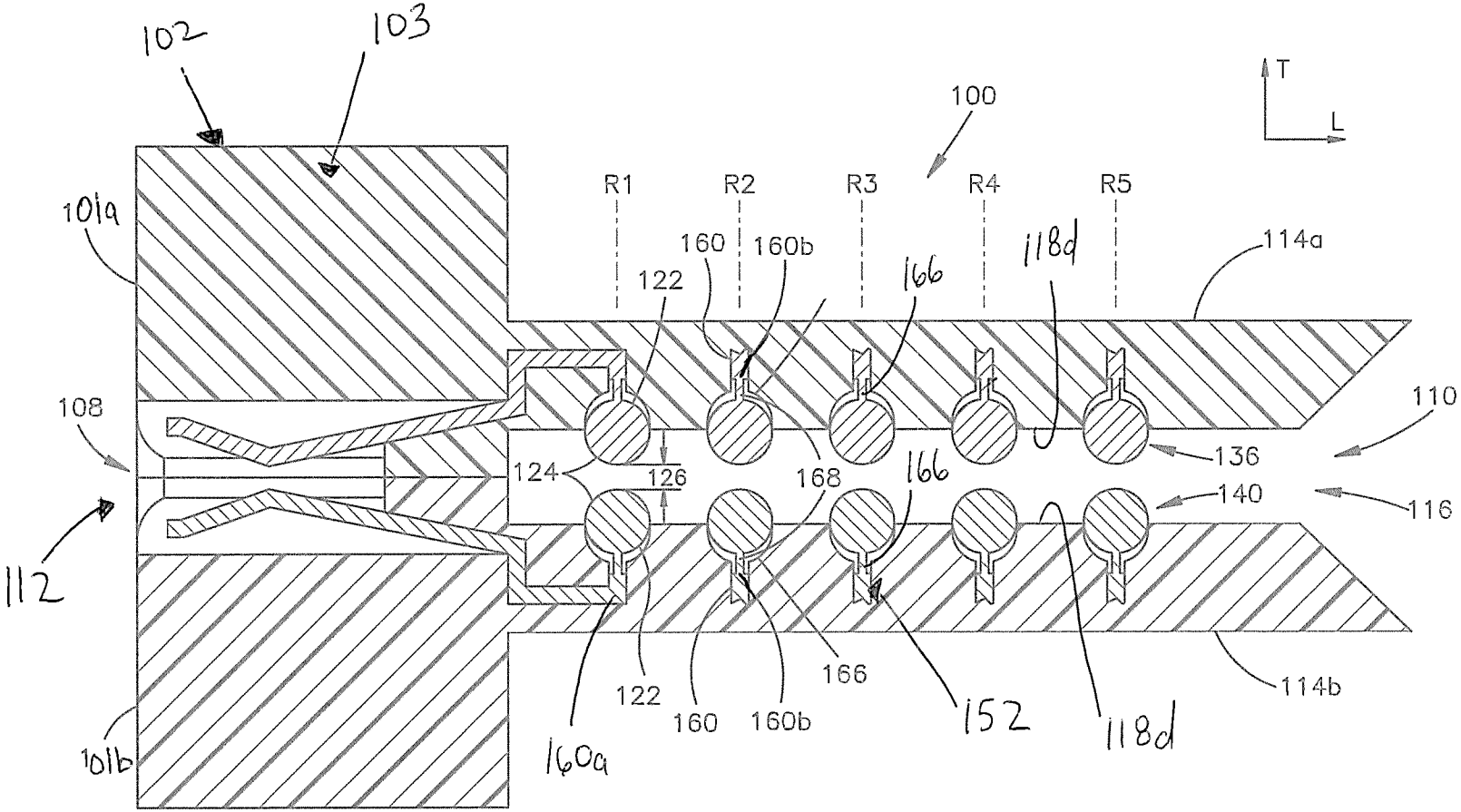
FIG. 5 is a side section view of another straddle mount electrical connector that includes fusible elements that include respective necks in accordance with yet another embodiment.

Referring also to FIGS. 4-5, in alternative embodiments the mounting interface 110 of the electrical connector 100 can be configured to receive printed circuit boards of varying thickness. It is known that the thickness of a printed circuit board can deviate from its specified value, typically by as much as 10%, for instance due to anomalies in manufacturing processes. If a printed circuit board, such as the first printed circuit board 200, has a thickness greater than the solder ball spacing distance 126 of the mounting interface 110, the leading edge of a printed circuit board can interfere with one or more of the solder balls 124, for instance by shearing solder material from the solder balls 124 during insertion of the printed circuit board. Such shearing might compromise the integrity of the electrical connection between the electrical connector 100 and a printed circuit board, such as the first printed circuit board 200. In order to mitigate the potential for interference, such as solder shear, between the printed circuit board 200 and the fusible elements 106 of the electrical connector 100, the mounting interface 110 of the electrical connector 100 can be configured to receive printed circuit boards of varying thicknesses, for example in accordance with the below described alternative embodiments.

Referring to FIG. 4, in accordance with an embodiment, the mounting interface 110 of the electrical connector 100 can be configured to receive printed circuit boards of varying thicknesses, for instance by configuring the fusible elements 106 of the first and/or second pluralities 136 and 140 of fusible elements 106 such that the mounting interface 110 defines at least two regions of differing solder ball spacing. For example, in accordance with the illustrated embodiment, the mounting interface 110 can define a first or rearward region 162 having a solder ball spacing distance 126' that is wider than the solder ball spacing distance 126 of a second or forward region 164, such that the solder ball spacing of the mounting interface 110 narrows as the first printed circuit board 200 advances toward the rear wall 105 along the longitudinal direction L.

includes a first group of the first and second pluralities of fusible elements that are substantially round so as to define a first diameter; and a second region that includes a second group of the first and second pluralities of fusible elements that are substantially round so as to define a second diameter that is larger than the first diameter, wherein the second region is disposed closer to the rear wall of the housing body than the first region along the longitudinal direction More specifically, the first region 162 can include a first group of solder balls 124 disposed in the R3, R4, and R5 row positions of the upper and lower element support members 114*a* and 114*b*, respectively. Each solder ball 124 in the first region 162 can define a cross-sectional dimension, for instance a first diameter D1, such that the first region 162 of the mounting interface 110 defines solder ball spacing distance 126'. The second region 164 can include a second group of solder balls 124 disposed in the R1 and R2 row positions of the upper and lower element support members 114*a*, 114*b*, respectively. Each solder ball 124 in the second region 164 can have a cross-sectional dimension, for instance a second diameter D2 that is greater than the diameter D1, such that the second region 164 of the mounting interface 110 defines a solder ball spacing distance 126 that more narrow as measured along the transverse direction T than the solder ball spacing distance 126'.

Thus, a first solder ball 124 of the first plurality 136 of solder balls 124 can define a cross-sectional dimension that is different than that of a second solder ball 124 of the first plurality 136 of solder balls 124, and a first solder ball 124 of the second plurality 140 of solder balls 124 can define a cross-sectional dimension that is different than that of a second solder ball 124 of the second plurality 140 of solder balls 124. Further, the first region 162 can include a first group of the first and second pluralities 136 and 140 of fusible elements 106 that are substantially round so as to define the first diameter D1, and the second region 164 can include a second group of the first and second pluralities 136 and 140 of fusible elements 106 that are substantially round so as to define a second diameter D2 that is larger than the first diameter, and, in accordance with the illustrated embodiment, the second region 164 can be disposed closer to the rear wall 105 of the housing body 103 than the first region 162 along the longitudinal direction L.

Configuring the solder balls 124 of the first and second regions 162 and 164 in accordance with the illustrated embodiment can allow the first printed circuit board 200 with a thickness TH that is larger than solder ball spacing distance 126 to be at least partially inserted into the mounting interface 110, such as fully inserted relative to the first region 162, before the leading edge of the first printed circuit board 200 comes into contact with the solder balls 124 that are supported by the electrical connector 100. As the printed circuit board 200 advances further forward into the mounting interface 110, the solder balls 124 of the first and second pluralities 136 and 140 that are disposed in the second region 164 can come into contact with respective contact pads affixed to the upper and/or lower surfaces 202 and 204 of the first printed circuit board 200, as described above. Following insertion of the printed circuit board 200, the solder reflow process can be initiated, during which electrical connections can be established between the solder balls 124 of the first and second pluralities 136 and 140 of both the first and second regions 162 and 164 and respective contact pads of the first printed circuit board 200, as described above, thereby creating electrical connections between the electrical contacts 104 of the first and second pluralities 134 and 138 of electrical contacts 104 and the respective contact pads of the first printed circuit board 200. It should be appreciated that the electrical connector 100 is not limited to the illustrated configuration of solder balls 124 in the regions 162 and 164, and that the fusible elements 106 can alternatively be configured in any regions as desired.

Referring particularly to FIG. 5, in accordance with another embodiment, the mounting interface 110 of the electrical connector 100 can be configured to receive printed circuit boards of varying thicknesses, for instance by configuring the electrical contacts to be moveable so as to increase the spacing distance 126 as an electrical component is received in the receptacle 116. The fusible elements 106 of the first and/or second pluralities 136 and 140 of fusible elements 106 can be configured to be moveable relative to respective ones of the first and second pluralities of recesses 122. For example, in accordance with the illustrated embodiment, the mounting ends 152 of the first and second pluralities 134 and 138 of electrical contacts 104 can define first and second pluralities of anchoring members 166 that suspend fusible elements 106 relative to respective ones of the recesses 122. Thus, each fusible element 106 of the first and second pluralities 136 and 140 of fusible elements 106 can be suspended relative to a respective one of the first and second plurality of recesses 122, and the mounting ends 152 of the first and second pluralities 134 and 138 of electrical contacts 104 can define respective first and pluralities of anchoring members 166 that support the first and second pluralities 136 and 140 of fusible elements, respectively.

More specifically, the distal end 160*b* of each solder tail 160 can define an anchoring member 166, such as a neck 168. The anchoring member 166 can support a respective solder ball 124 relative to the intermediate portion 148 of a respective electrical contact 104. Each neck 168 can define a smaller cross-sectional dimension relative to a plane defined along the longitudinal and lateral directions L and A, respectively, than that of the remainder of the respective solder tail 160. The necks 168 can further define a length along the transverse direction such that each respective solder ball 124 is offset from its respective recess 122 along the transverse direction T. Each neck 168 can be configured to allow its respective solder ball 124 to move between a first extended position relative to its respective recess 122, and a second seated position wherein the solder ball 124 is seated relative to its recess. Thus, it can be said that the solder ball 124 abuts the recess when the solder ball 124 is in the seated position. It can further be said that at least a select one, for instance both, of the first and second pluralities 136 and 140 of fusible elements 106 can be seated in ones of the respective recesses 122 such that the at least select one of the first and second pluralities 136 and 140 of fusible elements 106 abut the respective one of the first and second inner surfaces 118*d*. Alternatively, at least a select one, for instance both, of the first and second pluralities 136 and 140 of fusible elements 106 can be in an unseated position such that the at least select one of the first and second pluralities 136 and 140 of fusible elements 106 are spaced apart from both of the first and second inner surfaces 118*d* along the transverse direction T.

With continuing reference to FIG. 5, In accordance with the illustrated embodiment, each neck 168 can be configured to compress along the transverse direction T, and thus each neck can compress relative to its respective electrical contact 104. Stated another way, the first and second pluralities of anchoring members 166 can be configured to be compressed relative to a respective one of the pluralities 134 and 138 of electrical contacts 104, such that each fusible element 106 of the first and second pluralities 136 and 140 of fusible elements 106 can move relative to a respective one of the first and second pluralities of recesses 122.

The capability of the solder balls 124 to be operated from the suspended (extended) position to the seated position within the respective recess 122 can enable the solder balls 124, and thus the mounting interface 110, to conform to the thickness of a complementary electrical component inserted into the receptacle 116 of mounting interface 110, such as the first printed circuit board 200. For example, in accordance with the illustrated embodiment, if the thickness TH of a first printed circuit board 200 to be inserted into the receptacle 116 of the mounting interface 110 is greater than the solder ball spacing distance 126, as the first printed circuit board 200 is inserted into the receptacle 116, the leading edge of the first printed circuit board 200 can come into contact with the solder balls 124 of the first and second pluralities 136, 140 in the R5 row, and as the leading edge of the printed circuit board comes into contact with the solder balls 124 of the R5 row, the leading edge can exert forces against the solder balls 124, for instance along the transverse direction T, that cause the solder balls 124 to be biased apart relative to each other. If the transverse forces exerted by the first printed circuit board 200 are of a magnitude that overcomes resistive forces provided by the necks 168, the necks 168 can compress in the transverse direction T, allowing the solder balls 124 to move toward their respective recesses 122. Thus the solder balls 124 can move from the extended position at least partially toward the seated position. The solder balls 124 in the remaining rows R1-R4 can be configured to operate similarly to those in the R5 row. Configuring the solder balls 124 to be moveable relative to their respective recesses 122 can act to mitigate forces opposite to the insertion direction that can be imparted to the first printed circuit board 200 by the solder balls 124, for example forces resulting from friction between the solder balls 124 and the upper and/or lower surfaces 202 and 204 of the first printed circuit board 200. Once the first printed circuit board 200 is fully inserted into the receptacle 116, the reflow process can be carried out as described above to solder the electrical contacts 104 to respective contact pads on the first printed circuit board 200.

The electrical contacts can be configured to operate resiliently or non-resiliently. Similarly, the anchoring members 166, for instance the necks 168, can be configured to operate resiliently or non-resiliently. For instance, the necks 168 can be configured to remain in their at least partially seated position as the first printed circuit board 200 is inserted. Alternatively, the necks 168 can be configured to operate resiliently, such that each neck 168 will maintain a force against the respective surface of the first printed circuit board 200. Thus, the necks 168 can be configured for spring like operation with respect to the respective surface of the first printed circuit board 200. It should be appreciated that the anchoring members 166 of the electrical connector 100 are not limited to the illustrated necks 168, and that the electrical connector 100 can alternatively be configured with any other suitable anchoring members 166 as desired. For instance, each solder ball 124 of the first and second pluralities 136 and 140 can be attached to a respective inside surface 118*d* of a respective one of the element support members 114, such that each solder ball 124 "floats" within its respective recess 122.

Although the straddle mount electrical connector with fusible elements has been described herein with reference to preferred embodiments and/or preferred methods, it should be understood that the words which have been used herein are words of description and illustration, rather than words of limitation, and that the scope of the instant disclosure is not intended to be limited to those particulars, but rather is meant to extend to all structures, methods, and/or uses of the herein described straddle mount electrical connector with fusible elements. Those skilled in the relevant art, having the benefit of the teachings of this specification, may effect numerous modifications to the straddle mount electrical connector with fusible elements as described herein, and changes may be made without departing from the scope and spirit of the instant disclosure, for instance as recited in the appended claims.

What is claimed:

1. An electrical connector comprising:

a connector housing that defines a mounting interface configured to be mounted to a first electrical component and a mating interface configured to mate with a second electrical component, the connector housing including a housing body and opposed first and second element support members that are fixed with respect to the housing body, the first and second element support members spaced from one another such that a receptacle is defined therebetween at the mounting interface, the receptacle configured to receive the first electrical component;

a first plurality of electrical contacts supported by the connector housing, the first plurality of electrical contacts defining respective first mating ends that are configured to electrically connect to the second electrical component, and a plurality of first mounting ends;

a first plurality of fusible elements supported by respective ones of the first mounting ends and in electrical communication with respective ones of the first mating ends, each of the first plurality of fusible elements supported by the first element support member and configured to be fused to a first side of the first electrical component;

a second plurality of electrical contacts supported by the connector housing, the second plurality of electrical contacts defining respective second mating ends that are configured to electrically connect to the second electrical component, and a plurality of second mounting ends; and a second plurality of fusible elements supported by respective ones of the second mounting ends and in electrical communication with respective ones of the second mating ends, each of the second plurality of fusible elements supported by the second element support member and configured to be fused to a second side of the first electrical component that is opposite the first side.

2. The electrical connector of claim 1, wherein the first element support member defines a first inner surface and the second element support member defines a second inner surface that faces the first inner surface so as to define the receptacle therebetween, and the first and second pluralities of fusible elements are carried by the first and second inner surfaces, respectively.

3. The electrical connector of claim 2, wherein the first and second pluralities of fusible elements are disposed at least partially in the first and second inner surfaces, respectively.

4. The electrical connector of claim 3, wherein the first and second inner surfaces define respective first and second pluralities of recesses, the fusible elements of the first and second pluralities of fusible elements disposed in the first and second pluralities of recesses, respectively.

5. The electrical connector of claim 1, wherein the first and second pluralities of fusible elements are disposed at least partially between the first and second inner surfaces.

6. The electrical connector of claim 2, wherein the first and second inner surfaces are substantially parallel with respect to each other.

7. The electrical connector of claim 2, wherein the housing body includes first and second housing bodies, the first and second housing bodies configured to be attached to each other, the first element support member extending from the first housing body, and the second element support member extending from the second housing body.

8. The electrical connector of claim 7, wherein the first and second element support members are integral with the first and second housing bodies, respectively.

9. The electrical connector of claim 1, wherein the first and second pluralities of fusible elements comprise first and second pluralities of solder balls.

10. The electrical connector of claim 9, wherein a first solder ball of the first plurality of solder balls defines a cross-sectional dimension that is different than that of a second solder ball of the first plurality of solder balls.

11. The electrical connector of claim 10, wherein a first solder ball of the second plurality of solder balls defines a cross-sectional dimension that is different than that of a second solder ball of the second plurality of solder balls.

12. The electrical connector of claim 1, wherein the first element support member defines a first inner surface that defines a first plurality of recesses, the second element support member defines a second inner surface that defines a second plurality of recesses, and each fusible element of the first and second pluralities of fusible elements is suspended relative to a respective one of the first and second plurality of recesses.

13. The electrical connector of claim 12, wherein the mounting ends of the first and second pluralities of electrical contacts define respective first and second pluralities of anchoring members that support the first and second pluralities of suspended fusible elements, respectively.

14. The electrical connector of claim 13, wherein each of the first and second pluralities of anchoring members are configured to be compressed relative to a respective one of the plurality of electrical contacts, such that each fusible element of the first and second pluralities of fusible elements can move relative to a respective one of the first and second pluralities of recesses.

15. The electrical connector of claim 14, wherein the first and second pluralities of fusible elements comprise first and second pluralities of solder balls.

16. The electrical connector of claim 1, wherein each of the first plurality of fusible elements is integral with a respective one of the first plurality of electrical contacts, and each of the second plurality of fusible elements is integral with a respective one of the second plurality of electrical contacts.

17. The electrical connector of claim 1, the first and second mating ends are spaced apart so as to receive the second electrical component therebetween, such that the first mating ends electrically connect to a first side of the second electrical component, and the second mating ends electrically connect to a second side of the second electrical component that is opposite the first side of the second electrical component.

18. The electrical connector of claim 17, wherein the second plurality of fusible elements are spaced from the first plurality of fusible elements along a select direction so as to define a spacing distance therebetween, and the second plurality of mating ends are spaced from the first plurality of mating ends along the select direction.

19. An electrical connector configured to mount to a first printed circuit board and configured to mate with a second printed circuit board along a longitudinal direction, the electrical connector comprising:

a dielectric connector housing including 1) a housing body that defines a mating interface configured to mate with the second printed circuit board and a rear wall that is spaced from the mating interface along the longitudinal direction, and 2) first and second element support members that extend from the rear wall of the housing body and are spaced from each other along a transverse direction that is substantially perpendicular to the longitudinal direction, the first element support member defining a first inner surface and the second element support member defining a second inner surface that faces the first inner surface and is spaced from the first inner surface along the transverse direction so as to define a receptacle configured to receive the first printed circuit board therein;

a first and second plurality of electrical contacts that are supported by the first and second element support members, respectively, each of the first and second plurality of electrical contacts including respective mating ends that are configured to mate with the second printed circuit board, each of the first and second plurality of electrical contacts further including respective mounting ends that are configured to mount to the first printed circuit board when the first printed circuit board is received in the receptacle; and a first plurality of fusible elements that are supported by ones of the mounting ends of the first plurality of electrical contacts and a second plurality of fusible elements that are supported by ones of the mounting ends of the second plurality of electrical contacts, wherein the first plurality of fusible elements and the second plurality of fusible elements are configured to fuse to opposed surfaces of the first printed circuit board such that an electrical connection is established between the first printed circuit board and the second printed circuit board when the electrical connector is mated to the second printed circuit board.

20. The electrical connector as recited in claim 19, wherein the first and second fusible elements comprise solder balls.

21. The electrical connector as recited in claim 19, wherein:

each of the first plurality of fusible elements define a respective lowermost surface; and each of the second plurality of fusible elements define a respective uppermost surface that faces one of the lowermost surfaces and is spaced from the one lowermost surface a spacing distance along the transverse direction, the fusible elements configured to move as the first printed circuit board is received in the receptacle of the electrical connector so as to increase the spacing distance.

22. The electrical connector as recited in claim 21, where in each of the electrical contacts define a respective neck that supports one of the fusible elements and is elongate in the transverse direction, the neck configured to compress along the transverse direction so as to increase the spacing distance as the first printed circuit board is received in the receptacle of the electrical connector along the longitudinal direction.

23. The electrical connector as recited in claim 19, wherein the first inner surface defines a first plurality of recesses and the second inner surface defines a second plurality of recesses, wherein at least a select one of the first and second pluralities of fusible elements is seated in ones of the respective recesses such that the at least select one of the first and second pluralities of fusible elements abut the respective one of the first and second inner surfaces.

24. The electrical connector as recited in claim 19, wherein the first inner surface defines a first plurality of recesses and the second inner surface defines a second plurality of recess, wherein at least a select one of the first and second pluralities of fusible elements is in an unseated position such that the at least select one of the first and second pluralities of fusible elements is spaced apart from both of the first and second inner surfaces along the transverse direction.

25. The electrical connector as recited in claim 19, the electrical connector further comprising:

a first region that includes a first group of the first and second pluralities of fusible elements that are substantially round so as to define a first diameter; and a second region that includes a second group of the first and second pluralities of fusible elements that are substantially round so as to define a second diameter that is larger than the first diameter, wherein the second region is disposed closer to the rear wall of the housing body than the first region along the longitudinal direction.

26. An electrical connector assembly comprising:

a first printed circuit board;

an electrical connector mounted to the first printed circuit board and configured to mate with a second printed circuit board so as to establish an electrical connection between the first printed circuit board and second printed circuit board, the electrical connector including a dielectric connector housing that includes 1) a housing body that defines a mating interface configured to mate with the second printed circuit board and a rear wall that is spaced from the mating interface along the longitudinal direction, and 2) first and second element support members that extend from the rear wall of the housing body and are spaced from each other along a transverse direction that is substantially perpendicular to the longitudinal direction, the first element support member defining a first inner surface and the second element support member defining a second inner surface that faces the first inner surface and is spaced from the first inner surface along the transverse direction so as to define a receptacle configured to receive the first printed circuit board therein;

a first and second plurality of electrical contacts that are supported by the first and second element support members, respectively, each of the first and second plurality of electrical contacts including respective mating ends that are configured to mate with the second printed circuit board, each of the first and second plurality of electrical contacts further including respective mounting ends that are configured to mount to the first printed circuit board when the first printed circuit board is received in the receptacle; and a first plurality of fusible elements that are supported by ones of the mounting ends of the first plurality of electrical contacts and a second plurality of fusible elements that are supported by ones of the mounting ends of the second plurality of electrical contacts, wherein the first plurality of fusible elements and the second plurality of fusible elements are configured to fuse to opposed surfaces of the first printed circuit board such that an electrical connection is established between the first printed circuit board and the second printed circuit board when the electrical connector is mated to the second printed circuit board.

* * * * *